US009975326B2

(12) United States Patent
Smith et al.

(10) Patent No.: US 9,975,326 B2
(45) Date of Patent: May 22, 2018

(54) CONTINUOUS INK JET PRINT HEAD WITH ZERO ADJUSTMENT EMBEDDED CHARGING ELECTRODE

(71) Applicant: VIDEOJET TECHNOLOGIES, INC., Wood Dale, IL (US)

(72) Inventors: Robert Smith, Thrapston (GB); Omer Salhadin, Cambridge (GB)

(73) Assignee: Videojet Technologies Inc., Wood Dale, IL (US)

( * ) Notice: Subject to any disclaimer, the term of this patent is extended or adjusted under 35 U.S.C. 154(b) by 0 days. days.

(21) Appl. No.: 15/316,368

(22) PCT Filed: Jun. 4, 2015

(86) PCT No.: PCT/US2015/034256

§ 371 (c)(1),
(2) Date: Dec. 5, 2016

(87) PCT Pub. No.: WO2015/187983

PCT Pub. Date: Dec. 10, 2015

(65) Prior Publication Data

US 2017/0197406 A1 Jul. 13, 2017

Related U.S. Application Data

(60) Provisional application No. 62/008,219, filed on Jun. 5, 2014.

(51) Int. Cl.
*B41J 2/035* (2006.01)

(52) U.S. Cl.
CPC ..... *B41J 2/035* (2013.01)

(58) Field of Classification Search
CPC ..... B41J 2/035; B41J 2/09; B41J 2/02; B41J 2/085; B41J 2/08; B41J 2002/02; B41J 2002/022; B41J 2002/032
See application file for complete search history.

(56) References Cited

U.S. PATENT DOCUMENTS 4,338,610 A 7/1982 Sellen et al.
4,364,055 A 12/1982 Aiba
(Continued)

FOREIGN PATENT DOCUMENTS

DE 102010016858 A1 11/2011
EP 0531156 A2 3/1993
(Continued)

*Primary Examiner* — Juanita D Jackson
(74) *Attorney, Agent, or Firm* — Robert J. Follett

(57) ABSTRACT

A continuous ink jet print head, including: a droplet generator (32, 32', 32") for generating ink droplets (64); a charging electrode (22, 22', 22") having a passageway (74, 74', 74") through which the ink droplets travel to receive a charge; a deflection electrode (60, 60', 60") for deflecting the charged ink droplets; a gutter (50, 50', 50", 50'") having a gutter entrance (52, 52', 52", 52'"); wherein the passageway is aligned with the gutter entrance through which uncharged droplets enter; and a mounting deck (10, 10', 10") configured to secure the gutter entrance into a fixed, nonadjustable gutter entrance position (56, 56', 56", 56'") and to secure the charging electrode into a fixed, nonadjustable charging electrode position (24, 24', 24") relative to the gutter entrance.

17 Claims, 12 Drawing Sheets

(56) References Cited

U.S. PATENT DOCUMENTS

| | | | | |
|---|---|---|---|---|
| 4,568,947 | A | | 2/1986 | Regnualt |
| 4,682,183 | A | | 7/1987 | Elchinger et al. |
| 4,791,434 | A | | 12/1988 | Wills |
| 4,800,398 | A | * | 1/1989 | Naruse ..... B41J 2/02 347/49 |
| 4,847,631 | A | | 7/1989 | Naruse et al. |
| 4,990,932 | A | | 2/1991 | Houston |
| 5,030,973 | A | | 7/1991 | Nonoyama et al. |
| 5,160,939 | A | | 11/1992 | Bajeux et al. |
| 5,363,124 | A | * | 11/1994 | Arway ..... B41J 2/085 347/74 |
| 5,455,606 | A | | 10/1995 | Keeling et al. |
| 5,455,611 | A | | 10/1995 | Simon et al. |
| 5,491,499 | A | | 2/1996 | Bibbe et al. |
| 5,623,292 | A | | 4/1997 | Shrivastava et al. |
| 5,710,579 | A | | 1/1998 | Hahs et al. |
| 5,793,398 | A | | 8/1998 | Hennig |
| 5,796,419 | A | | 8/1998 | Clark et al. |
| 6,280,023 | B1 | | 8/2001 | Ufkes |
| 6,357,860 | B1 | | 3/2002 | Rhodes |
| 6,464,322 | B2 | | 10/2002 | Dunand |
| 6,467,880 | B2 | | 10/2002 | Rhodes |
| 6,607,257 | B2 | | 8/2003 | Szumla et al. |
| 6,622,266 | B1 | | 9/2003 | Goddard et al. |
| 6,712,451 | B2 | | 3/2004 | Madziarz et al. |
| 6,726,298 | B2 | | 4/2004 | Anderson et al. |
| 6,866,367 | B2 | | 3/2005 | Szumla |
| 7,346,086 | B2 | | 3/2008 | Ryan et al. |
| 7,393,085 | B2 | | 7/2008 | Lecheheb et al. |
| 8,449,054 | B2 | | 5/2013 | Harris et al. |
| 8,454,128 | B2 | | 6/2013 | Fishkin et al. |
| 8,474,930 | B2 | | 7/2013 | Rasmussen |
| 2005/0110836 | A1 | | 5/2005 | Colombat et al. |
| 2007/0064068 | A1 | | 3/2007 | Piatt |
| 2008/0170108 | A1 | | 7/2008 | Lee et al. |
| 2008/0284835 | A1 | | 11/2008 | Panchawagh |
| 2009/0033727 | A1 | | 2/2009 | Anagnostopoulos et al. |
| 2009/0120512 | A1 | | 5/2009 | Berry et al. |
| 2010/0045758 | A1 | | 2/2010 | Okazawa |
| 2010/0238243 | A1 | | 9/2010 | Tomlin et al. |
| 2011/0316933 | A1 | | 12/2011 | Fishkin et al. |
| 2013/0057904 | A1 | | 3/2013 | Soto et al. |

FOREIGN PATENT DOCUMENTS

| | | | |
|---|---|---|---|
| EP | 0805037 | A2 | 4/1997 |
| EP | 0780231 | A1 | 6/1997 |
| EP | 1093918 | B1 | 4/2001 |
| EP | 0813974 | B1 | 3/2003 |
| EP | 1013458 | | 8/2003 |
| EP | 1847391 | A1 | 10/2007 |
| EP | 2082883 | A2 | 7/2009 |
| EP | 2393054 | A1 | 7/2011 |
| EP | 2555113 | A1 | 6/2013 |
| FR | 2636884 | A1 | 3/1990 |
| GB | 2447919 | A | 10/2008 |
| GB | 2479751 | A | 10/2011 |
| JP | 5896561 | | 6/1983 |
| JP | 60187556 | | 9/1985 |
| JP | 2000229419 | | 8/2000 |
| WO | 199706009 | A1 | 2/1997 |
| WO | 199828146 | A1 | 7/1998 |
| WO | 2002100645 | | 12/2002 |
| WO | 2008050141 | A1 | 5/2008 |
| WO | 2009049130 | A1 | 4/2009 |
| WO | 2015187839 | A1 | 12/2015 |
| WO | 2015187926 | A1 | 12/2015 |
| WO | 2015187983 | A2 | 12/2015 |

* cited by examiner

CONTINUOUS INK JET PRINT HEAD WITH ZERO ADJUSTMENT EMBEDDED CHARGING ELECTRODE

FIELD OF THE INVENTION

The invention relates to a print head for a continuous ink jet printer having a zero-adjustment mount for a charging electrode.

BACKGROUND OF THE INVENTION

In ink jet printing systems a printed image is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurized ink to a print head drop generator where a continuous stream of ink emanating from a nozzle is broken up into individual regular drops by, for example, an oscillating piezoelectric element. The drops are directed past a charging electrode where they are selectively and separately given a predetermined charging before passing through a transverse electric field provided across a pair of deflection electrodes. Each charged drop is deflected by the field by an amount that is dependent on its charging magnitude before impinging on the substrate whereas the uncharged drops proceed without deflection and are collected at a gutter from where they are recirculated to the ink supply for reuse. The charged drops bypass the gutter and hit the substrate at a position determined by the charging on the drop and a position of the substrate relative to the print head.

Proper alignment among the droplet generator, the nozzle, the charging electrode, the deflection electrodes, and the gutter are imperative in order to ensure that the ink droplets begin to travel along an intended course and any deflections are effected as intended. Conventional print heads include an adjustable mount for the charging electrode that permits adjustment of the print head alignment. This has been necessary to accommodate misalignments that frequently occur during operation and handling of the print head.

BRIEF SUMMARY

The present disclosure provides a print head for a continuous ink jet printer having a zero-adjustment mount for a charging electrode. In particular, it provides a print head wherein at least several of the nozzle, the charging electrode, the deflection electrode, and the gutter are fixed in relation to each other and non-adjustable in relation to each other and to the mounting deck.

In one aspect, a continuous ink jet print head includes a droplet generator configured to generate ink droplets, a charging electrode downstream of the droplet generator and including a passageway through which the ink droplets travel to receive a charge, and a deflection electrode for deflecting charged ink droplets. A gutter includes a gutter entrance through which uncharged droplets enter and which is aligned with the droplet generator. A mounting deck is configured to secure the gutter entrance into a fixed, non-adjustable gutter entrance position and to secure the charging electrode into a fixed, nonadjustable charging electrode position, both relative to the mounting deck.

In another aspect, a continuous ink jet print head includes a monolithic mounting deck configured to secure a droplet generator, a nozzle, a charge electrode, and a gutter in a fixed positional relationship relative to each other and to define an undeflected flight path from the droplet generator, through the nozzle, through the charge electrode, and to the gutter. At least one cavity is defined by the monolithic mounting deck and includes a cavity wall configured to contact and secure at least one of the droplet generator, the nozzle, and the charge electrode in a non-adjustable positional relationship relative to the undeflected flight path. The cavity wall is also configured to permit a droplet to travel unobstructed along the undeflected flight path toward the gutter.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

The invention is explained in the following description in view of the drawings that show.

DETAILED DESCRIPTION OF THE INVENTION

The present inventors have recognized that adjusting relative positions of the nozzle, the charging electrode and the gutter consumes a considerable amount of time and resources. While the various adjusting arrangements provide for the flexibility necessary to properly align the components, the very nature of the adjusting arrangements sometimes permits misalignments to occur in the first place.

Hence, the inventors have realized that eliminating the adjusting arrangements altogether will reduce the time and resources necessary for continued printing operations, and hence the inventors have devised a unique mounting deck that properly positions the print head components upon initial assembly and which does not allow for any adjustment or misalignment of the position of the components. Eliminating the adjusting arrangements by using the disclosed mounting deck eliminates the opportunity for misalignments previously made possible by the presence of the adjusting arrangements.

Figure 1:
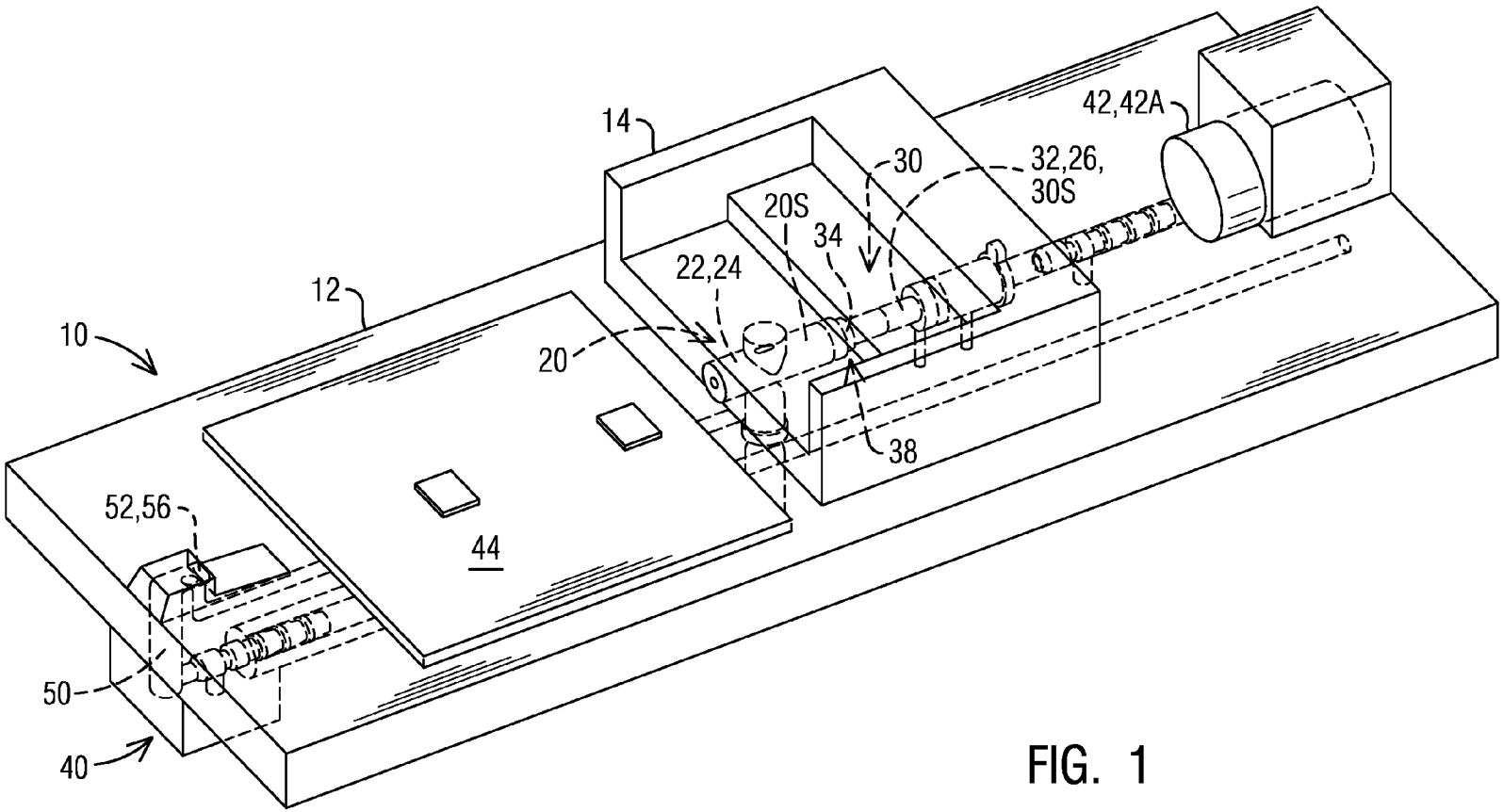
FIG. 1 is a perspective view of an exemplary embodiment of a mounting deck.

FIG. 1 shows a perspective view of an exemplary embodiment of a mounting deck 10 having a lower portion 12 and a housing portion 14. The mounting deck 10 may be made of plastic and may be a monolithic structure. Suitable materials for mounting deck 10 include the Noryl™ PPX™ range of materials manufactured by SABIC of Saudi Arabia, polyphenylene sulfide ("PPS"), and IXEF® plastic manufactured by Solvay Plastics of Brussels, Belgium. An example of the mounting deck 10 is an injection molded part where the lower portion 12 and the housing portion 14 are molded in a single step. Alternately, one part may be overmolded around another part to form the mounting deck 10. For example, the lower portion 12 may be cast around the housing portion 14 to form an integrated structure. Still further, the mounting deck 10 may be otherwise assembled of a lower portion 12 and a housing portion 14 that are configured to fit together in only one manner. The result is a structure that can only take a single positional configuration. Further, various other possible exemplary embodiments may include a larger or smaller housing portion 14, multiple housing portions 14, or may take other shapes altogether. The outer dimensions of the mounting deck 10 are limited only by the print head housing (not shown) into which the mounting deck 10 must fit and the shapes necessary to permit the printing operation.

A last-chance filter 42 may be fixed to the mounting deck 10 with a block 42A, which may be integrally formed with the lower portion 12, or separately mounted to the lower portion 12. The last-chance filter 42 receives ink and prepares it for delivery to the droplet generator. The mounting deck 10 may include a droplet generator cavity 30 having a droplet generator cavity surface 30S configured to receive a droplet generator 32 having a nozzle 34 in a press fit or other applicable relationship. The droplet generator 32 may be a piezo-electric pistol that breaks a stream of ink into individual droplets. This relationship will secure the droplet generator 32 into a nonadjustable droplet generator position 36, leaving a gap 38 between the downstream disposed charging electrode 22 and the nozzle 34. Consequently, the droplet generator cavity 30 itself must be formed so that it positions the charging electrode 22 properly with respect to the charging electrode 22 and the other components.

The mounting deck 10 may include a charging electrode cavity 20 having a charging electrode cavity surface 20S configured to receive a charging electrode 22 in a press fit relationship. This relationship will secure the charging electrode 22 into a nonadjustable charging electrode position 24. Consequently, the charging electrode cavity 20 itself must be formed so that it positions the charging electrode 22 properly with respect to the other components. In one embodiment, the charge electrode 22 includes a cylindrical shape surrounding the undeflected flight path, and is secured in a non-adjustable position generally concentric with the undeflected flight path.

The mounting deck 10 includes an ink return path 40 shown in this exemplary embodiment as including a gutter 50 that has a gutter entrance 52. The gutter entrance 52 is an opening formed in the mounting deck 10 and hence it is preferably fixed in a nonadjustable gutter entrance position 56. However, in another embodiment, the gutter 50 may be adjustable. The gutter 50 is also formed in the mounting deck 10 as an integral passageway (i.e., defined by material that constitutes the mounting deck 10) and is effective to return ink droplets to an ink reservoir (not shown). The ink return path 40 may include a passageway formed underneath the deck surface 54. The ink return path 40 may be in fluid communication with a pump (not shown) and reservoir (not shown) to control a flow of ink received in gutter and flowing toward the reservoir.

Figure 2:
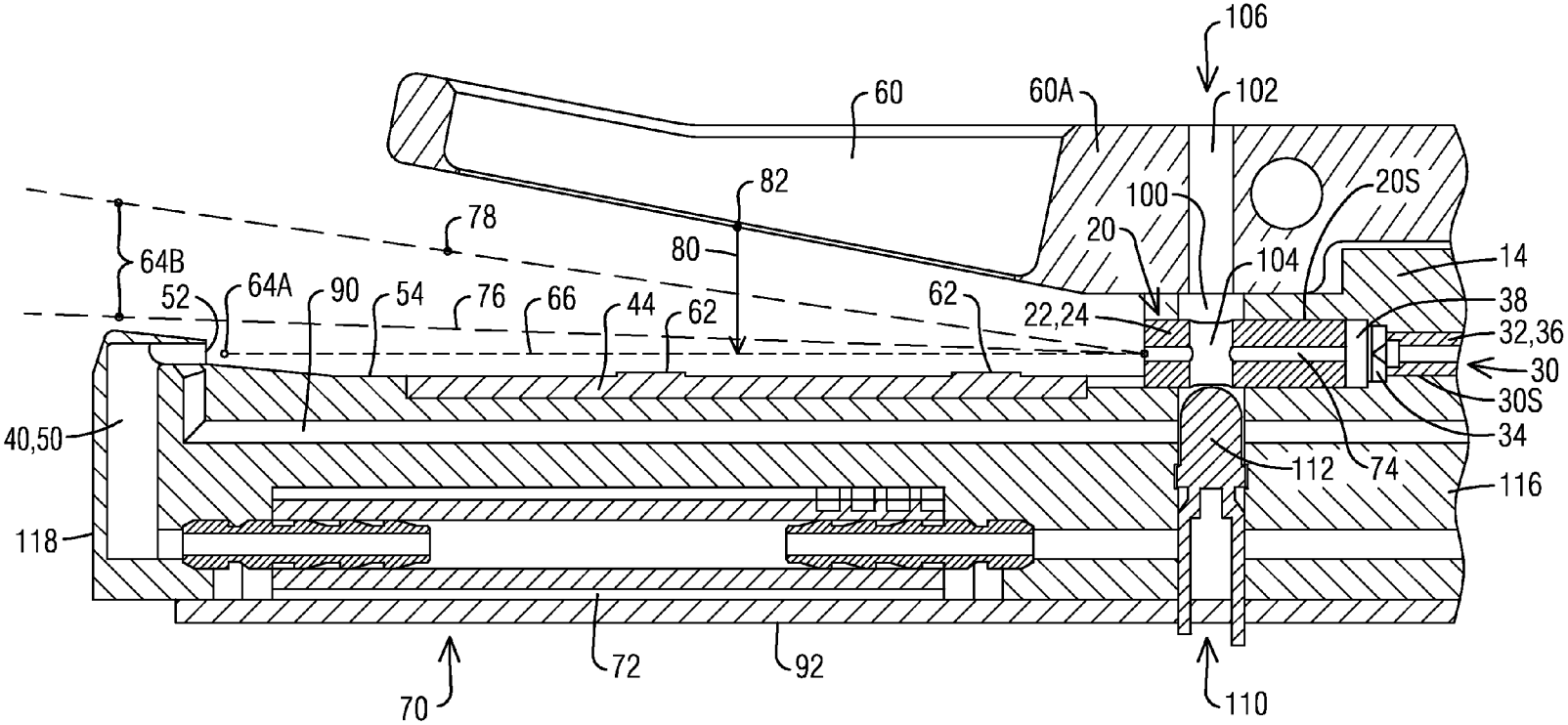
FIG. 2 is a cross sectional side view of the mounting deck of FIG. 1.

FIG. 2 is a cross sectional side view of the mounting deck 10 of FIG. 1. A deflection electrode 60 is housed by a deflection electrode housing 60A that is, in turn, secured to the housing portion 14. The deflection electrode housing 60A holds the deflection electrode 60 in a single positional relationship with the mounting deck 10. A ground electrode 44 is similarly secured to the mounting deck 10. Phase and velocity sensors 62 are secured to the mounting deck 10. During operation the droplet generator 32 generates individual droplets 64 of ink and propels each droplet 64 from the nozzle 34 and through the charging electrode 22. If an ink droplet 64A is not charged in the charging electrode 22 it continues along an undeflected flight path 66 and into the gutter entrance 52. The uncharged droplet 64A then travels in the gutter 50 to return to an ink reservoir (not shown). The gutter 50 may alternately be a separate tube that may or may not be embedded within the mounting deck 10. The mounting plate 10 may also include an ink return sensor recess 70 configured to secure an ink return sensor 72 that monitors a flow of ink in the gutter 50.

In one exemplary embodiment the ink return sensor 72 may be an electrode sensor configured to detect the presence of ink in the ink return path 40 by sensing a flow of electrical current through ink disposed between the electrodes. The amount of ink present between the electrodes and the rate of flow of the ink will influence the amount of current that flows between the electrodes. The amount of current flow can be used to gauge the amount of ink present.

Each of the components should be properly positioned for the printing operation to function as intended. The droplet generator 32 and its nozzle 34 must be aligned with the gutter entrance 52 so that an uncharged droplet 64A emitted from the nozzle 34 takes a flight path that will ensure its arrival in the gutter entrance 52. The droplet generator 32 and its nozzle 34 must also be aligned with the charging electrode 22, and in particular a passageway such as, but not limited to, a passageway 74 through the charging electrode 22. Passageway 74 may be cylindrical in shape with the charge electrode 22 having an outer cylindrical shape that surrounds the undeflected flight path. Alternatively, the charge electrode may include two flat plate electrodes and the passageway is the area between the electrodes. The alignment of the droplet generator 32 and its nozzle 34 with the charge electrode 22 is important to ensure that the flight path of all ink droplets not be obstructed. In addition, since a deviation from an expected position of the uncharged droplet 64A within the charging electrode 22 may result in a variation in a charge that is subsequently imparted to the uncharged droplet 64A, the alignment is important to ensure that a proper charge is imparted to the uncharged droplet 64A.

Upon exiting the charging electrode 22 the droplet's flight path takes it between the deflection electrode 60 and the ground electrode 44, where selectively charged droplets 64B are deflected from the undeflected flight path 66 to a deflected flight path. The deflected flight path can be any flight path within a range of deflected flight paths bounded by a least deflected flight path 76 and a most deflected flight path 78. The deflection electrode 60 deflects the charged droplet 64B by interacting with a charge present in the charged droplet 64B. Since a distance 80 from the undeflected flight path 66 and a given point 82 on the deflection electrode 60 influences the amount of deflection that a charged droplet 64B will experience for a given charge, it can be seen that the alignment of the deflection electrode 60 and the ground electrode 44 and the phase and velocity detecting sensors 62 with respect to the undeflected flight path 66 is also important. The phase and velocity detecting sensors 62 detect a phase and a velocity of the charged droplets 64B and this also requires a proper alignment between the phase and velocity detecting sensors 62 and the charged droplets 64B. If the deflection electrode 60, the charge electrode 44, and the phase and velocity detecting sensors 62 are not aligned as intended the deflection experienced by the charged droplet 64B may not be the same as the intended deflection. This may translate into an improper flight path for the charged droplet 64B and hence, an improper print. Consequently, it is also important to ensure the deflection electrode 60, the charge electrode and the phase and velocity detecting sensors 62 are also properly positioned.

Previously, adjusting arrangements would enable an operator to adjust these components to ensure the proper positioning/alignment. This adjustment may be accomplished, for example, using a set screw arrangement. By adjusting one or more set screws a positional relationship between the components could be adjusted in any number of ways, including adjusting relative distances and orientations. However, the same adjusting arrangements also permitted movement/misalignment of the components. The mounting deck 10 disclosed herein eliminates this problem by ensuring that at least several of the charging electrode 22, the droplet generator 32, the gutter entrance 52, the deflection electrode 60, the ground electrode 44, and the phase and velocity detecting sensors 62 are all initially properly positioned/aligned in nonadjustable positions. In one embodiment, the charging electrode 22, the droplet generator 32, the deflection electrode 60, the ground electrode 44, are all non-adjustable and fixed in position with respect to each other and the mounting deck 10, but the gutter entrance 52 is adjustable. This arrangement that provides a fixed position of the components will ensure that an actual flight path taken by a charged droplet 64B is the flight path that was intended for that charged droplet 64B. The nonadjustable nature of the positioning eliminates the potential for misalignment that comes with adjusting arrangements. Thus, the components of this arrangement will remain properly aligned indefinitely, despite handling and operations that might misalign prior art devices.

The mounting deck 10 may further include a vent path 90 that provides fluid communication between the gutter 50 and the gutter entrance 52 and an ink reservoir (not shown) that may benefit from ventilation. Alternatively, the vent path 90 may provide fluid communication between the gutter 50 and a condenser (not shown) connected to the ink reservoir. The condenser receives vaporized solvent from the ink reservoir and air may be exhausted from the condenser and recirculated through the print head through the vent path 90. While the vent path 90 is shown as a passageway that is integral to the mounting deck 10 and which terminates at the gutter 50, it may alternately be a separate tube that may or may not be embedded within the mounting deck 10. Air exhausted from a reservoir may be drawn into the gutter and entrained with the ink. The ink and entrained air may then flow with the aid of the pump.

A printed circuit board ("PCB") 92 may be disposed on a bottom side of the mounting deck 10 and may be used to power and/or control various components disposed on the mounting deck 10. There may be a single PCB 92 or multiple PCB's 92 associated with the mounting deck 10.

The mounting deck 10 may further be configured to include a deck viewing window 100 that may cooperate with a deflection electrode viewing window 102 and a charging electrode viewing window 104 to permit observation of the passageway 74 through the charging electrode 22. The cooperation of these windows allows for a viewing window 106 through which an observer can look to see if ink droplets are forming as intended. The mounting deck 10 may further include a light source recess 110 configured to receive a light source 112 positioned so that the light source 112 will back-light the passageway 74, thereby helping the observer view the ink droplets. The mounting deck 10 includes a first end 116 and a second end 118.

Figure 3:
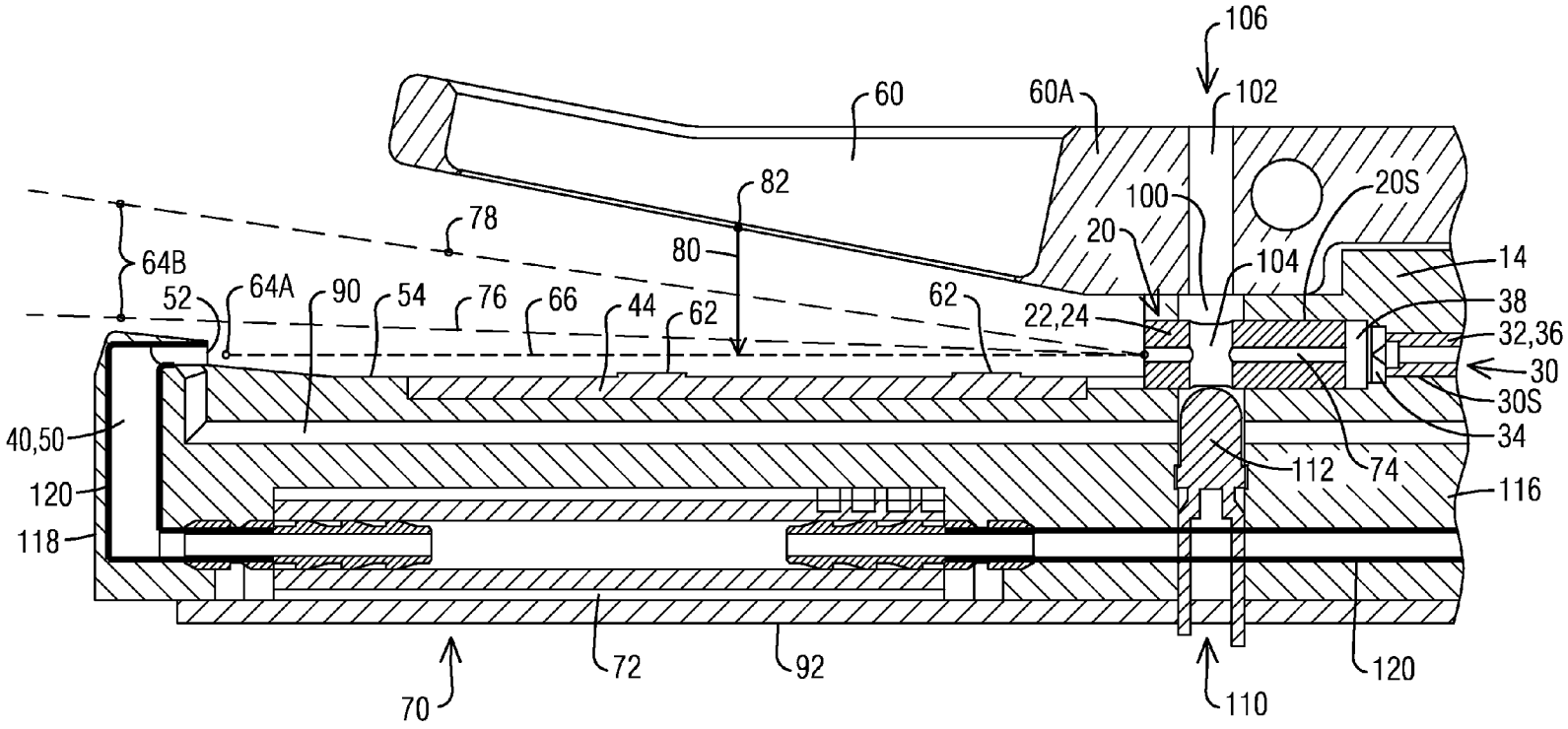
FIG. 3 is a cross sectional side view of an alternate embodiment of the mounting deck of FIG. 1

FIG. 3 is a cross sectional side view of an alternate embodiment of the mounting deck 10 where at least part of the ink return path is formed by a discrete ink return conduit 120 fully embedded in the mounting deck 10. Such an exemplary embodiment can be formed by, for example, casting the mounting deck around the ink return conduit 120. The ink return conduit 120 may extend a portion of or an entirety of the ink return path 40 and may be made of any suitable material, including metal or plastic tubing.

Figure 4:
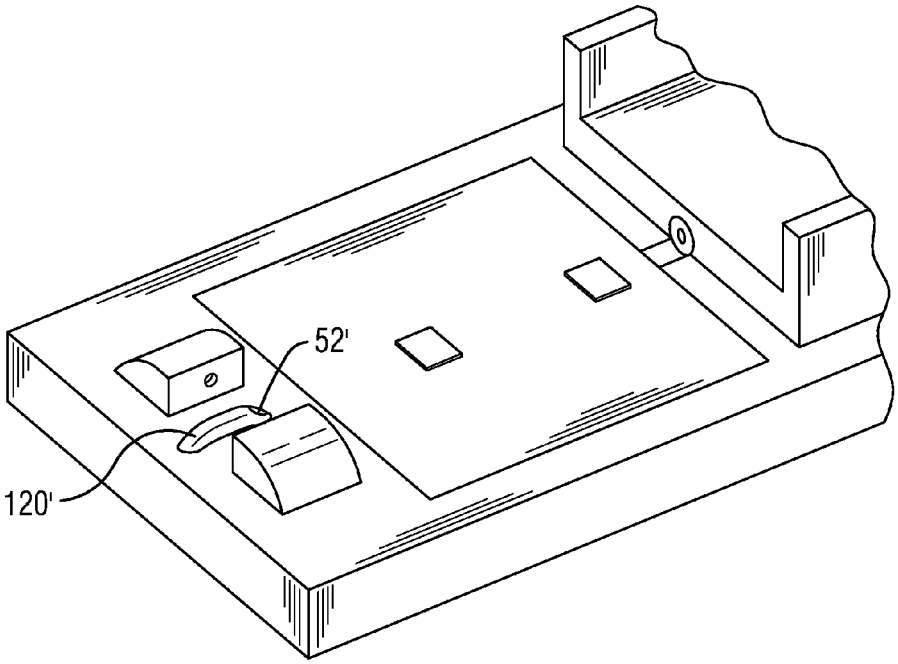
FIG. 4 is a perspective view of an alternate embodiment of the mounting deck of FIG. 1.

FIG. 4 is a perspective view of an alternate embodiment of the mounting deck 10 where the ink return path includes an alternate exemplary embodiment of the gutter 50 that is not fully embedded within the mounting deck 10. Instead, the gutter 50 exists at least partly outside of the mounting deck 10, though a section of the gutter 50 may or may pass through the mounting deck 10 or a portion of the mounting deck 10 such as the lower portion 12. The gutter 50 may extend a portion of the ink return path 40 to be connected at its bottom end to a horizontally disposes return line (not shown). Alternately, the gutter 50 may extend an entirety of the ink return path 40. The gutter 50 may be made of any suitable material, including metal or plastic tubing. The gutter 50 may have a gutter entrance 52' formed by drilling a hole into a straight tube, and then bending the tube to reach the shape visible in FIG. 4. Bending the tube in this manner may elongate the gutter entrance 52'. When assembled, the gutter entrance 52' is inclined with respect to the mounting deck 10 in an orientation that permits an uncharged droplet 64A to be farther from the mounting deck 10 and yet still enter the gutter entrance 52'. In other words, when seen from the perspective of the uncharged droplet 64A, a dimension the gutter entrance 52' normal to the mounting deck 10 will seem to be relatively larger than a dimension parallel to the mounting deck 10. This may be beneficial to accommodate any tolerance stacking that may occur in this direction in the components in the direction of elongation, which might result in uncharged droplets 64A not being perfectly centered in the gutter entrance 52' when traveling along the undeflected flight path 66.

Figure 5:
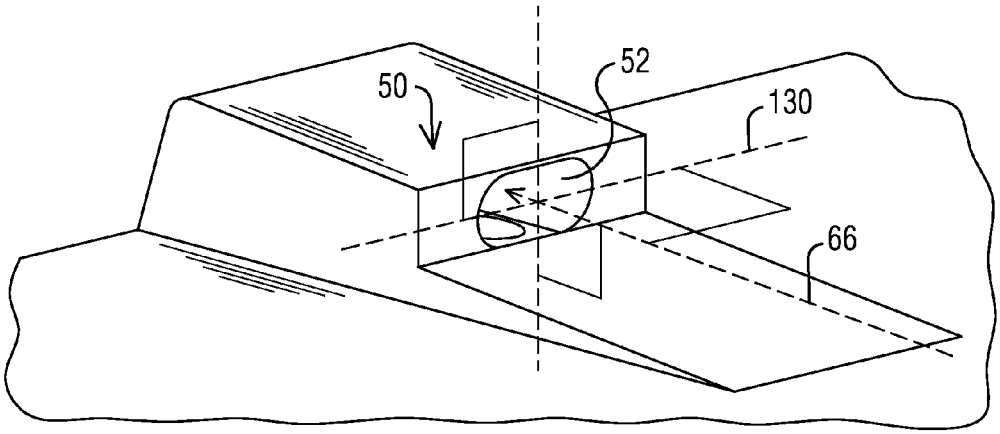
FIG. 5 is a perspective view of an exemplary embodiment of a gutter entrance of the mounting deck.

FIG. 5 is a perspective view of an exemplary embodiment of the gutter entrance 52, where the gutter entrance is elongated along a first axis 130 that is perpendicular to the undeflected flight path more than it is elongated along a second axis 132 that is perpendicular to the undeflected flight path and perpendicular to the first axis 130. This elongation accounts for an undeflected flight path 66 of a particular mounting deck 10 when lateral/side-to-side manufacturing tolerances and environmental variations, etc., are taken into account. These tolerances and variances may stack to create an undeflected flight path for a given mounting deck 10 that varies from an ideal/design undeflected flight path, but is still within an acceptable envelope. Stated another way, the elongation accounts for an undeflected flight path associated with a particular mounting deck 10 that is manufactured within dimensional tolerances, but where the dimensions of that particular mounting deck 10 are not exactly equal to the ideal design dimensions. In an exemplary embodiment, the gutter entrance 52 may be two millimeters wide and one millimeter high.

Figure 6:
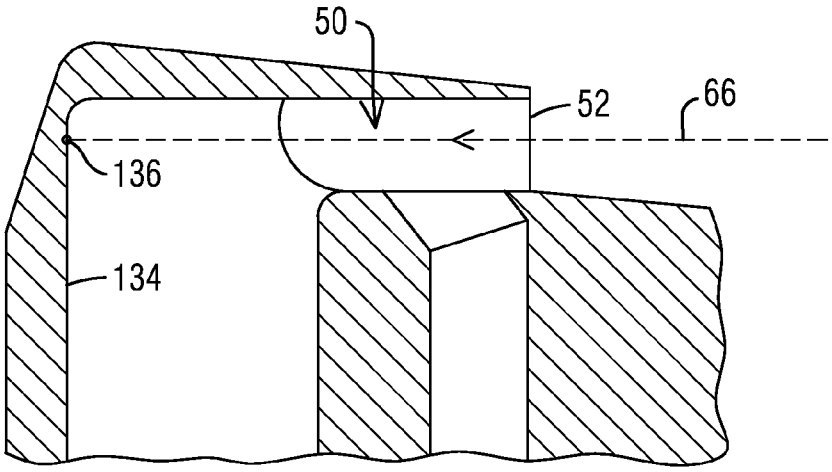
FIG. 6 is a cross sectional side view of the exemplary embodiment of the gutter of FIG. 5.

FIG. 6 is a cross sectional side view of an exemplary embodiment of the gutter 50. A surface 134 of the gutter 50 includes an impact point 136 where the uncharged droplet 64A traveling on the undeflected flight path 66 impacts the surface 134. In this exemplary embodiment the impact point 136 is disposed at three to six millimeters from the gutter entrance 52. An exemplary embodiment includes five millimeters. Placing the impact point 136 so far past the gutter entrance 52 minimizes the chances that any ink will splash back out of the gutter 50.

Figure 7:
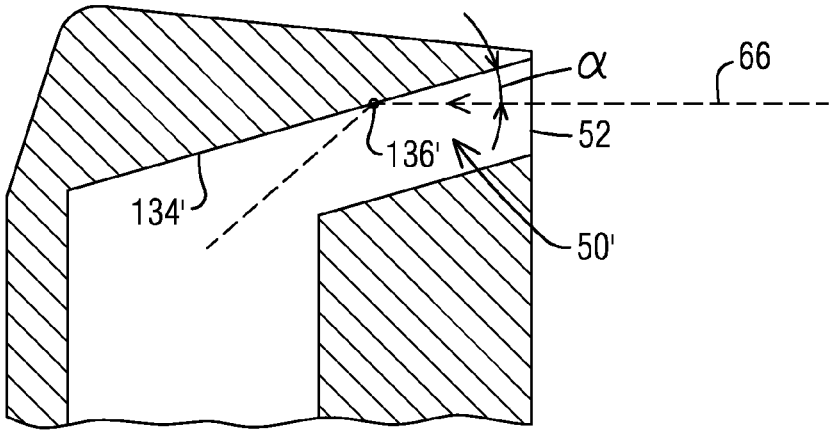
FIG. 7 is a cross sectional side view of an alternate exemplary embodiment of the gutter of FIG. 5.

FIG. 7 is a cross sectional side view of an alternate exemplary embodiment of the gutter 50', where the surface 134' on which the impact point 136' is disposed is angled such that upon impact with the surface 134' the uncharged droplet 64A is deflected farther and down into the gutter 50'. This deflection also reduces the chances that any ink will splash back out of the gutter 50'. The surface 134' may form an angle $\alpha$ of thirty to sixty degrees with the undeflected flight path 66. Exemplary embodiments include thirty, forty-five, and sixty degrees.

Figure 8:
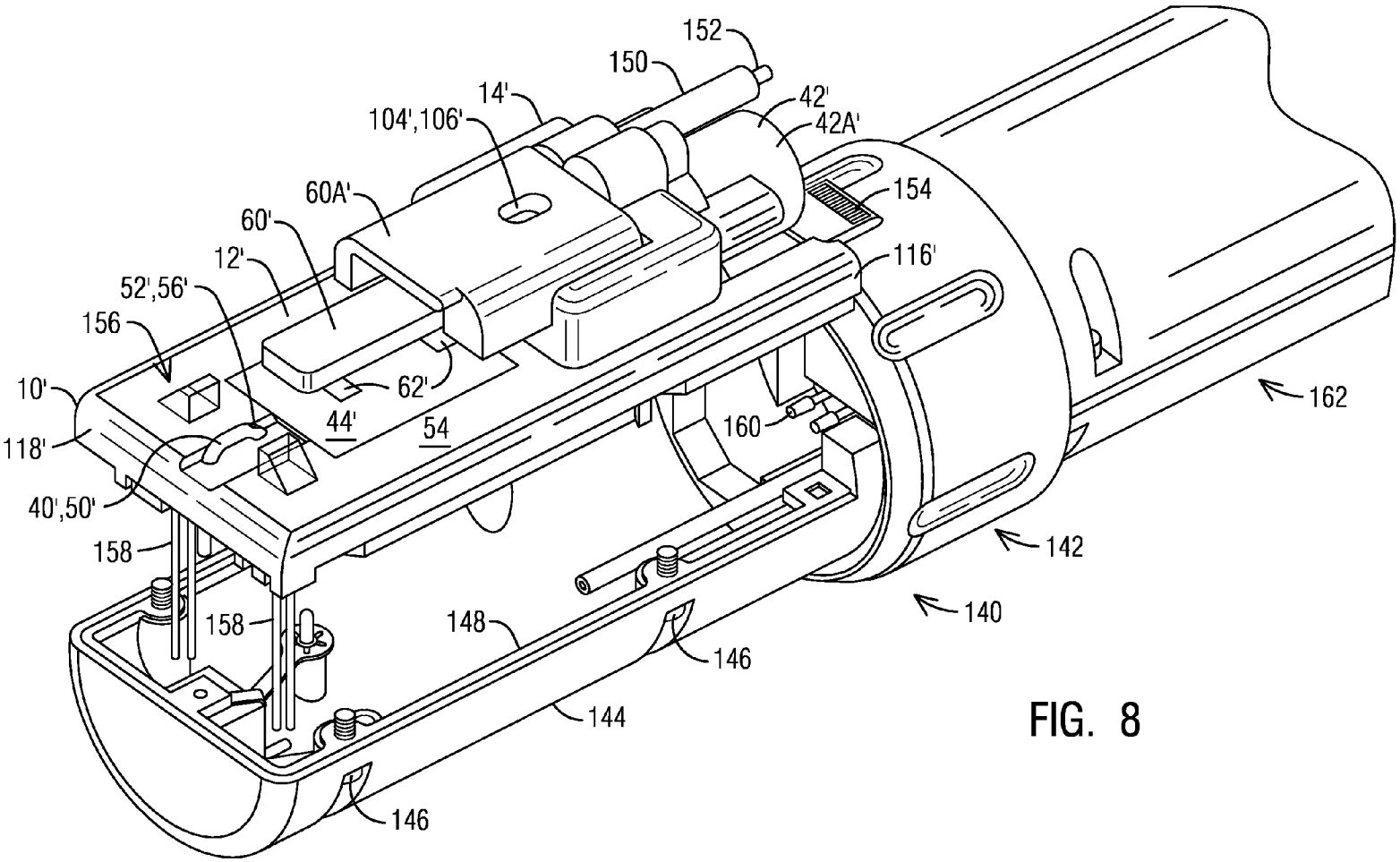
FIG. 8 is a perspective view of an alternate exemplary embodiment of the mounting deck.

FIG. 8 is a perspective view of an alternate exemplary embodiment of a mounting deck 10' including the first end 116' and the second end 118' that is a removable part of a print head 140 having a quick disconnect arrangement 142. In this exemplary embodiment the mounting deck 10' may be secured to a chassis 144 via screws 146 or other fasteners known to those in the art, and there may be a gasket 148 therebetween. As above, the lower portion 12' and the housing portion 14' may be a monolithic structure. For example, it may be a monolithic, cast, plastic component. Visible in this figure are the lower portion 12' and the housing portion 14'. The housing portion 14', as above, fits together with the mounting deck 10' and the housing portion 14' and the mounting deck 10' together form a structure with a single positional configuration therebetween.

Further visible are the ink return path 40', the last chance filter 42' fixed to the mounting deck 10' with a block 42A', the gutter 50', the gutter entrance 52', the deck surface 54', the nonadjustable gutter entrance position 56', the deflection electrode 60', the deflection electrode housing 60A' which holds the deflection electrode 60' in a single non-adjustable positional relationship with the mounting deck 10', the ground electrode 44', the phase and velocity detecting sensors 62', the charging electrode viewing window 104', the viewing window 106', a high voltage pin sleeve 150 surrounding a high voltage pin 152, and a PCB connector 154. A gutter buildup detection system 156 is positioned on the mounting deck 10' and configured to monitor for any unwanted buildup of ink on an external surface of the gutter 50'. Leads 158 associated with the gutter buildup detection system 156 extend toward the chassis 144 to be received by an associated receptacle (not shown) when the mounting deck 10' is secured to the chassis 144. Nipples 160 associated with the quick disconnect arrangement 142 receive fluid conduits necessary for operation (not shown) from the mounting deck 10', such as ink supply lines, ink return lines, and vent lines, etc., and provide fluid communication to a valve deck assembly 162.

Figure 9:
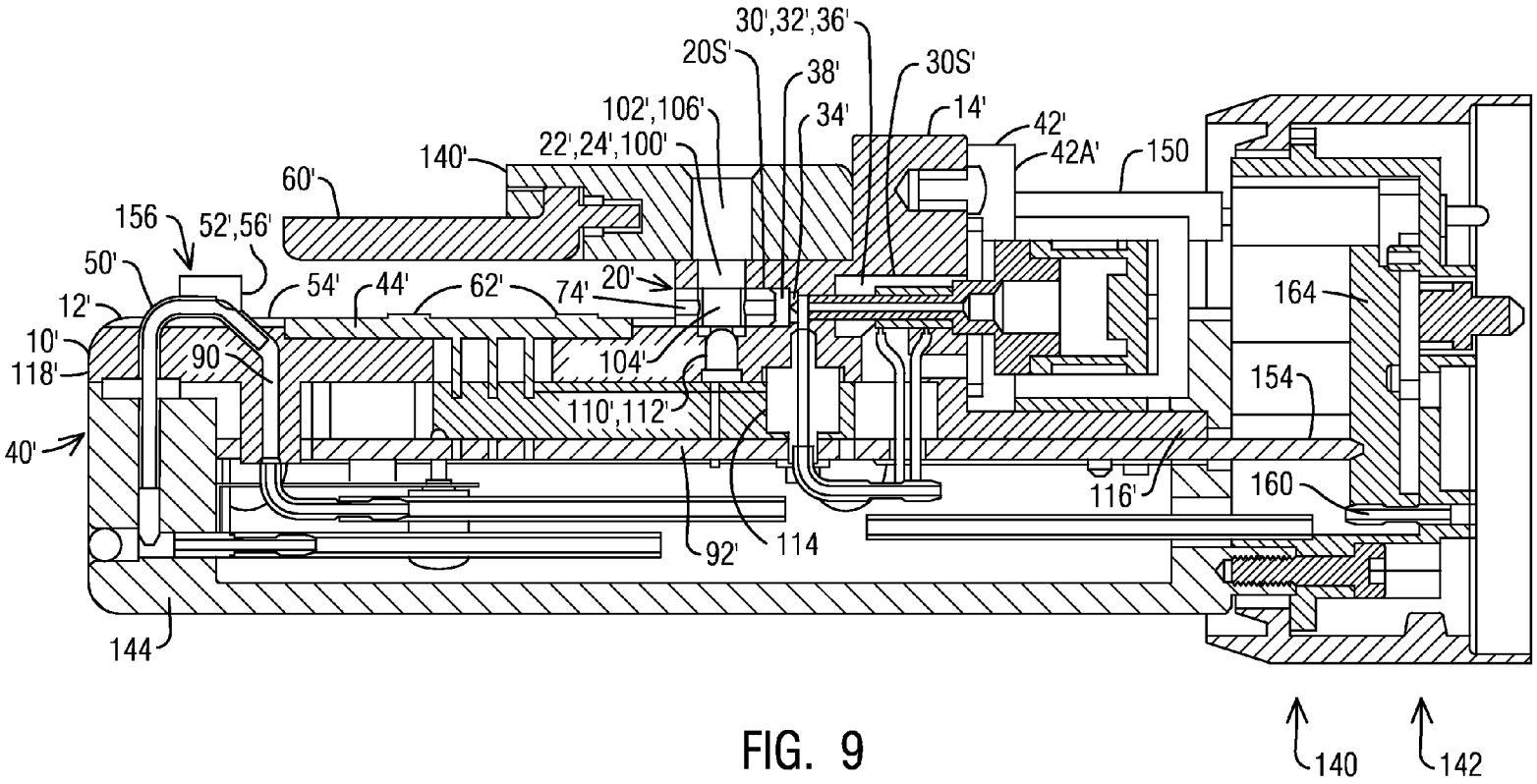
FIG. 9 is a cross sectional side view of the alternate exemplary embodiment of the mounting deck of FIG. 8.

FIG. 9 is a cross sectional side view of the alternate exemplary embodiment of the mounting deck of FIG. 8. In addition to that which is visible in FIG. 8, also visible in this figure are the charging electrode cavity 20', the charging electrode cavity surface 20S', the charging electrode 22', the nonadjustable charging electrode position 24', the droplet generator cavity 30', the droplet generator cavity surface 30S', the droplet generator 32', the nozzle 34', the nonadjustable droplet generator position 36', the gap 38', the last chance filter 42, the passageway 74', the vent path 90', the PCB 92', the deck viewing window 100', the deflection electrode viewing window 102', the viewing window 106', the light source recess 110', the light source 112', and a temperature sensor 114. It can be seen that the mounting deck 10' may interface with the valve deck assembly 162 through an interface 164 that is configured to receive at least one of the high voltage pin 152, the PCB connector 154, and the various fluid connections necessary for operation. The interface 164 shown is not meant to be limiting and other configurations may be used as is desired.

As with the exemplary embodiment of FIG. 1, each of the components in the exemplary embodiment of FIGS. 8 and 9 should be properly positioned for the printing operation to function as intended. The droplet generator 32' and its nozzle 34' must be aligned with the gutter entrance 52' so that an uncharged droplet 64A emitted from the nozzle 34' takes a flight path that will ensure its arrival in the gutter entrance 52'. The droplet generator 32' and its nozzle 34' must also be aligned with the charging electrode 22', and in particular a passageway such as, but not limited to, a passageway 74' through the charging electrode 22'. The proper positioning of these components is maintained by having the same nonadjustable components and positions as with the exemplary embodiment of FIG. 1, including the nonadjustable charging electrode position 24', the nonadjustable droplet generator position 36', and the nonadjustable gutter entrance position 56'.

Figure 10:
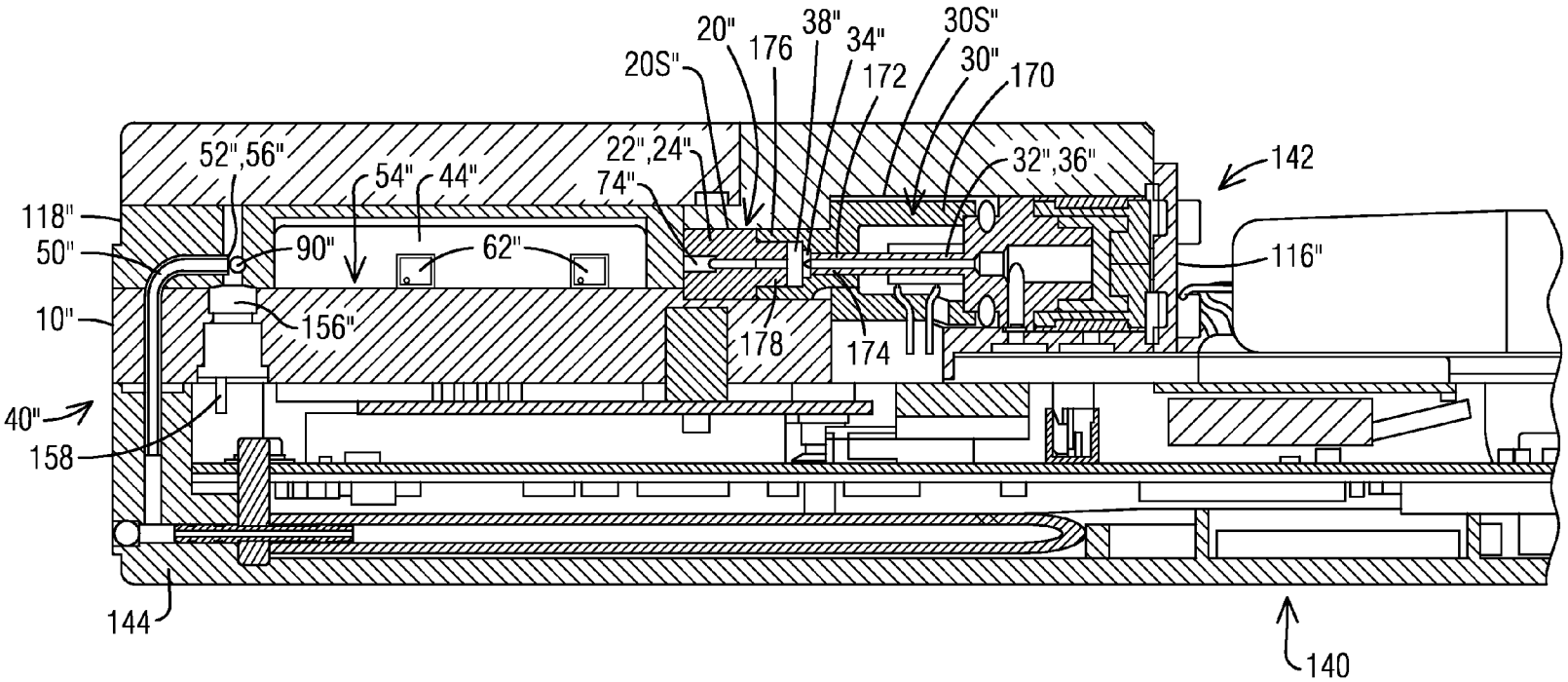
FIG. 10 is a cross sectional side view of an alternate exemplary embodiment of the mounting deck.

FIG. 10 is a side view of an alternate exemplary embodiment of a mounting deck 10" including the first end 116" and the second end 118" that is a removable part of a print head 140 having a quick disconnect arrangement 142. The mounting deck 10" may be a monolithic structure with no discernible lower or housing portion. For example, it may be a monolithic, cast, plastic component. Further visible are the ink return path 40", the gutter 50", the gutter entrance 52", the deck surface 54", and the nonadjustable gutter entrance position 56". A gutter buildup detection system 156" is positioned on the mounting deck 10" and configured to monitor for any unwanted buildup of ink on an external surface of the gutter 50". Leads 158 associated with the gutter buildup detection system 156" extend toward the chassis 144 to be received by an associated receptacle (not shown) when the mounting deck 10" is secured to the chassis 144.

Also visible in this figure are the charging electrode cavity 20", the charging electrode cavity surface 20S", the charging electrode 22", the nonadjustable charging electrode position 24", the droplet generator cavity 30", the droplet generator cavity surface 30S", the droplet generator 32", the nozzle 34", the nonadjustable droplet generator position 36", the gap 38", the phase and velocity detecting sensors 62", the passageway 74", and the vent path 90". The charging electrode cavity 20" and the droplet generator cavity 30" may be a combined/single cavity that houses the charging electrode 22", the droplet generator 32", and the nozzle 34". Any cavity is configured to permit a droplet to move along the undeflected flight path 66 unobstructed. Accordingly, the cavity or cavities may be open on one or both ends.

As with the exemplary embodiment of FIG. 1, each of the components in the exemplary embodiment of FIG. 10 should be properly positioned for the printing operation to function as intended. The droplet generator 32" and its nozzle 34" must be aligned with the gutter entrance 52" so that an uncharged droplet 64A emitted from the nozzle 34" takes a flight path that will ensure its arrival in the gutter entrance 52". The droplet generator 32" and its nozzle 34" must also be aligned with the charging electrode 22", and in particular a passageway such as, but not limited to, a passageway 74" through the charging electrode 22". The proper positioning of these components is maintained by having the same nonadjustable components and positions as with the exemplary embodiment of FIG. 1, including the nonadjustable charging electrode position 24", the nonadjustable droplet generator position 36", and the nonadjustable gutter entrance position 56".

Unlike the other exemplary embodiments, in this exemplary embodiment the lower portion 12" includes a ground electrode cavity 190 (see FIG. 11) having a ground electrode cavity surface 190S (see FIG. 11) to house the ground electrode 44" and the phase and velocity detecting sensors 62" as well as a deflection electrode cavity 192 (see FIG. 11) having a deflection electrode cavity surface 192S to house the deflection electrode 60". This holds the phase and velocity detecting sensors 62" as well as the deflection electrode 60" in a non-adjustable position, with respect to the other components so held. In addition, in this exemplary embodiment the droplet generator 32" includes an adapter body 170 having a tube recess 172 configured to receive a droplet generator tube 174, and a charge electrode recess 176 configured to receive a charge electrode protrusion 178. The tube recess 172 and the charge electrode recess are concentrically aligned with each other, and this ensures the droplet generator 32" and the charging electrode 22" are likewise aligned with each other, further ensuring positional relationships between the components are held.

Figure 11:
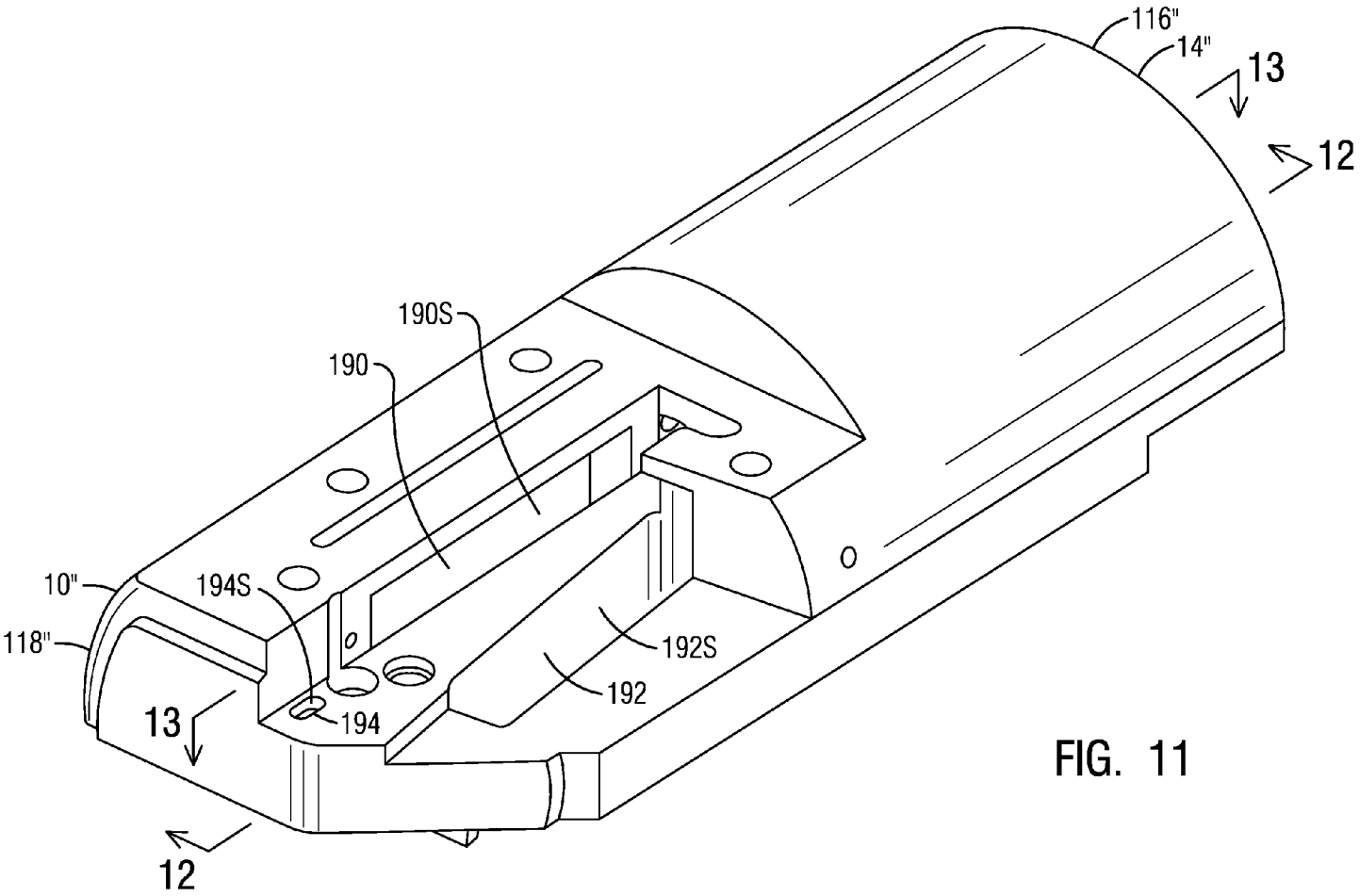
FIG. 11 is a perspective view of the mounting deck of FIG. 10.
Figure 12:
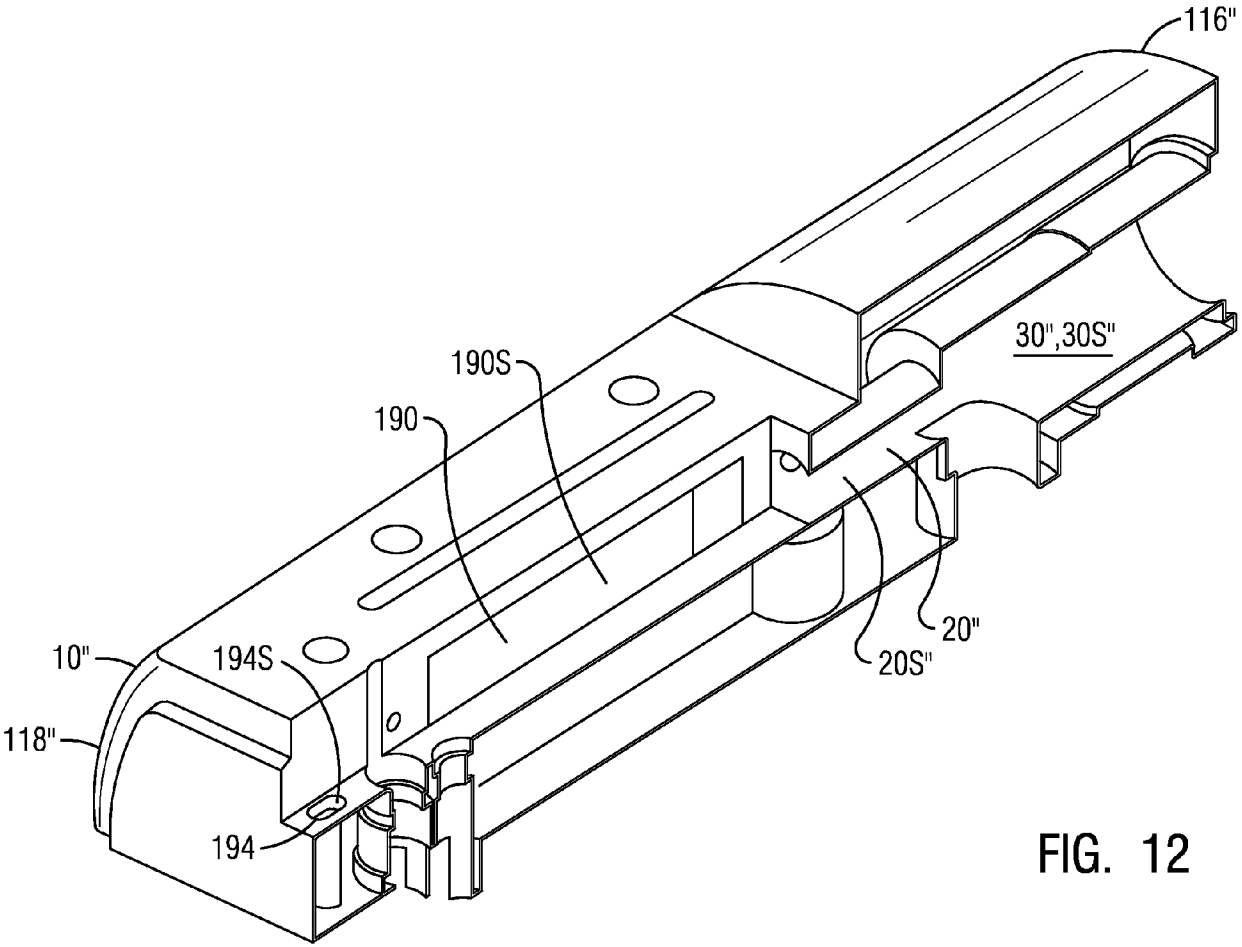
FIG. 12 is a cross sectional side view of the mounting deck of FIG. 10.
Figure 13:
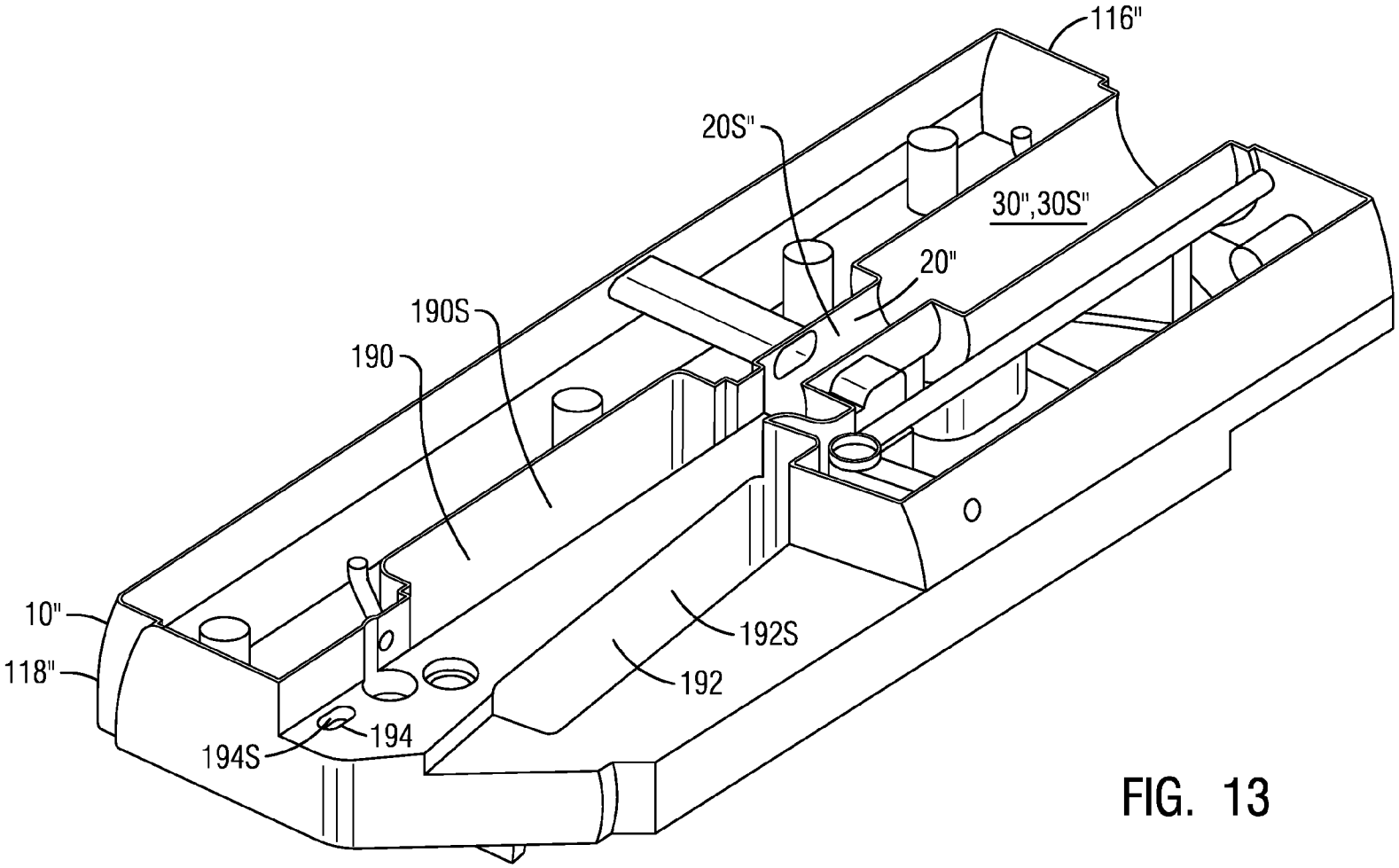
FIG. 13 is a cross sectional top view of the mounting deck of FIG. 10.

FIG. 11 is a perspective view of the mounting deck 10" of FIG. 10 showing a ground electrode cavity 190 and the ground electrode cavity surface 190S configured to hold the ground electrode 44" and the phase and velocity detecting sensors 62" in position, and a deflection electrode cavity 192 and the deflection electrode surface 192S configured to hold the deflection electrode 60" in position. Also visible is a gutter tube cavity 194 having a gutter tube cavity surface 194S in which the gutter 50" resides. FIG. 12 is a cross sectional side view of the mounting deck of FIG. 10 showing the ground electrode cavity 190, the ground electrode cavity surface 190S, the gutter tube cavity 194, the gutter tube cavity surface 194S, the droplet generator cavity 30", and the droplet generator cavity surface 30S". FIG. 13 is a cross sectional top view of the mounting deck of FIG. 10. showing the ground electrode cavity 190, the ground electrode cavity surface 190S, the deflection electrode cavity 192, the deflection electrode cavity surface 192S, the gutter tube cavity 194, the gutter tube cavity surface 194S, the droplet generator cavity 30", and the droplet generator cavity surface 30S". In this exemplary embodiment one or both of the ground electrode cavity 190 and the deflection electrode cavity 192 may be open on a bottom side, allowing for the deflection electrode 60" and/or the ground electrode 44" and the phase and velocity detecting sensors 62" to be installed from below.

Figure 14:
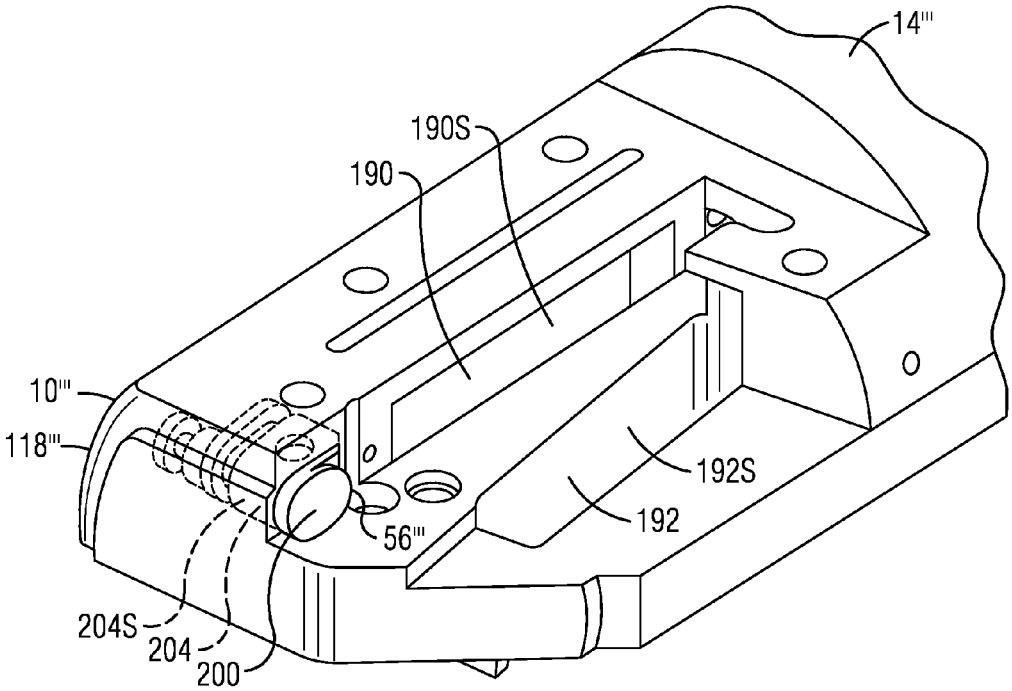
FIG. 14 is a perspective view of an alternate exemplary embodiment of the mounting deck of FIG. 10.

FIG. 14 is a perspective view of an alternate exemplary embodiment of the mounting deck 10'" of FIG. 10 including the first end 116'" and the second end 118'". In this exemplary embodiment the gutter tube of the gutter is replaced with a gutter block 200. The gutter block 200 may be made of a monolithic body that is cast, or machined, or otherwise formed as necessary. The gutter block 200 may be made of any suitable material known to those in the art, including, for example, stainless steel. Passages 202 (see FIGS. 15-16) may be formed in the gutter block 200 via machining processes such as, for example, drilling etc. The mounting deck 10'" may include a gutter block cavity 204 having a gutter block cavity surface 204S in which the gutter block 200 may reside in a non-adjustable position with respect to the mounting deck 10'". In this manner the gutter entrance 52'" (see FIG. 15) is held in the nonadjustable gutter entrance position 56'".

Figure 15:
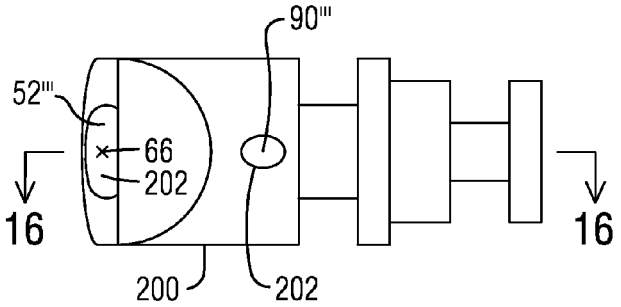
FIG. 15 is a front view of an alternate exemplary embodiment of the gutter shown in FIG. 14.
Figure 16:
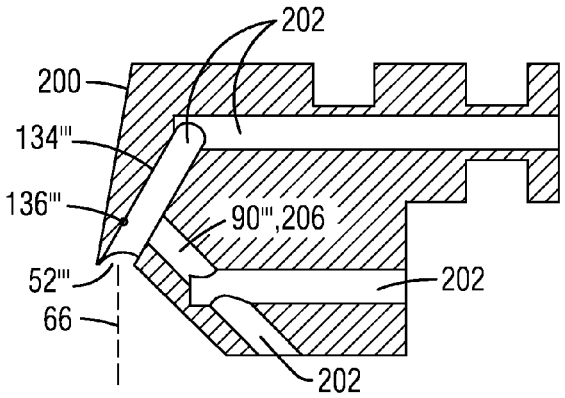
FIG. 16 is a top view of the alternate exemplary embodiment of the gutter shown in FIG. 14.

FIG. 15 is a front view of the gutter block 200 from the perspective of a droplet on the undeflected flight path 66 enroute to the gutter entrance 52'". In this exemplary embodiment the gutter entrance 52'" is elongated vertically. Alternately, or in addition, it may also be elongated horizontally, or in any direction desired. Also visible is a portion of the vent path 90'" that is also machined into the gutter block 200. FIG. 16 is a top view showing the gutter block 200. In this exemplary embodiment the surface 134'" on which the impact point 136'" is disposed is also angled such that upon impact with the surface 134'" the uncharged droplet 64A is deflected farther and down into the gutter block 200, similar to the arrangement of FIG. 7. Also visible is a portion 206 of the vent path 90'" that is formed in the gutter block 200. Various other passages may be formed in the gutter block 200 as desired.

From the foregoing it can be seen that the inventors have devised a unique mounting deck that holds some or all of the components responsible for droplet generation and flight in non-adjustable positions and positional relationships with respect to each other, and/or with respect to the undeflected flight path, and/or with respect to the mounting deck. This will eliminate effort and costs associated with adjusting components within a print head housing. Hence, the arrangement disclosed herein represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A continuous ink jet print head, comprising:

a droplet generator configured to generate ink droplets;

a charging electrode downstream of the droplet generator and comprising a passageway through which the ink droplets travel to receive a charge;

a deflection electrode for deflecting charged ink droplets;

a gutter comprising a gutter entrance through which uncharged droplets enter and which is aligned with the droplet generator; and a mounting deck configured to secure the gutter entrance into a fixed, nonadjustable gutter entrance position relative to the mounting deck, the mounting deck comprising a charge electrode cavity configured to receive the charging electrode in a press fit relationship between the charge electrode cavity and the charging electrode, thereby securing the charging electrode into a fixed, nonadjustable charging electrode position relative to the mounting deck.

2. The continuous ink jet print head of claim 1, wherein the mounting deck is characterized by a cast, monolithic body.

3. The continuous ink jet print head of claim 1, wherein the mounting deck is cast around at least one of the droplet generator, the charging electrode, the deflection electrode, and the gutter.

4. The continuous ink jet print head of claim 1, wherein the mounting deck further defines a droplet generator cavity configured to receive the droplet generator in a press fit relationship between the droplet generator cavity and the droplet generator, thereby securing the droplet generator in a respective non-adjustable position relative to the mounting deck.

5. The continuous ink jet print head of claim 1, wherein the mounting deck further comprises a deflection electrode cavity configured to receive the deflection electrode in a respective non-adjustable position relative to the mounting deck.

6. The continuous ink jet print head of claim 1, wherein the mounting deck defines therethrough at least a portion of an ink return path from the gutter entrance, and wherein the portion of the ink return path is formed integrally as part of the mounting deck.

7. The continuous ink jet print head of claim 1, wherein the mounting deck comprises an ink return sensor recess configured to secure an ink return sensor.

8. The continuous ink jet print head of claim 1, wherein the mounting deck defines therethrough at least a portion of a vent path terminating at a portion of the gutter.

9. The continuous ink jet print head of claim 8, wherein the portion of the vent path is positioned under a surface of the mounting deck and is formed integrally by material that constitutes part of the mounting deck.

10. The continuous ink jet print head of claim 1, wherein the mounting deck and the charging electrode each comprises a respective window and the respective windows cooperate to permit observation of the passageway through the charging electrode.

11. A continuous ink jet print head, comprising:

a monolithic mounting deck configured to secure a droplet generator, a nozzle, a charge electrode, and a gutter in a fixed positional relationship relative to each other and to define an undeflected flight path from the droplet generator, through the nozzle, through the charge electrode, and to the gutter; and at least one cavity defined by the monolithic mounting deck and comprising a cavity wall configured to directly contact and secure at least one of the droplet generator, the nozzle, and the charge electrode in a non-adjustable positional relationship relative to the undeflected flight path, the cavity wall also configured to permit a droplet to travel unobstructed along the undeflected flight path toward the gutter.

12. The continuous ink jet print head of claim 11, wherein the cavity wall directly contacts and secures the droplet generator, the nozzle, and the charge electrode in respective non-adjustable positions relative to the undeflected flight path via respective press fit relationships.

13. The continuous ink jet print head of claim 12, the at least one cavity further comprising:

a deflection electrode cavity configured to directly contact and secure a deflection electrode in a respective non-adjustable position relative to the undeflected flight path; and a gutter cavity comprising a gutter cavity wall configured to directly contact and secure the gutter in a respective non-adjustable position relative to the undeflected flight path.

14. The continuous ink jet print head of claim 11, wherein the cavity wall directly contacts and secures the droplet generator, the nozzle, and the charge electrode in respective non-adjustable positions relative to the undeflected flight path via respective press fit relationships, and wherein the droplet generator comprises a charge electrode recess configured to receive the charge electrode therein and to secure the droplet generator and the charge electrode in a respective non-adjustable positional relationship relative to each other.

15. The continuous ink jet print head of claim 11, wherein the charge electrode comprises a cylindrical shape surrounding the undeflected flight path, and wherein the at least one cavity secures the charge electrode in a non-adjustable position generally concentric with the undeflected flight path via a respective press fit relationship.

16. A continuous ink jet print head, comprising:

a droplet generator configured to generate ink droplets in flight;

a charging electrode downstream of the droplet generator and comprising a passageway through which the ink droplets travel to receive a charge;

a deflection electrode for deflecting charged ink droplets;

a gutter comprising a gutter entrance through which uncharged droplets enter and which is aligned with the passageway; and, a monolithic mounting deck configured to secure the gutter entrance into a fixed, nonadjustable gutter entrance position and to secure the charging electrode into a fixed, nonadjustable charging electrode position, both relative to each other;

wherein the mounting deck comprises: a first end and a second end; a first cavity in which the droplet generator is press fit directly against a surface of the mounting deck and a second cavity in which the charging electrode is press fit directly against the surface of the mounting deck and aligned with the droplet generator; and, wherein the gutter is disposed toward the second end, and wherein the gutter entrance is aligned with the charging electrode to receive the uncharged droplets from the droplet generator.

17. The continuous ink jet print head of claim 16, further comprising a deflection electrode cavity configured to secure the deflection electrode in a non-adjustable positional relationship relative to the charging electrode and the gutter entrance.

* * * * *